United States Patent [19]

Kohlstette

[11] 4,151,951

[45] May 1, 1979

[54] SELF-DUMPING CENTRIFUGAL SEPARATOR

[75] Inventor: Werner Kohlstette, Oelde, Fed. Rep. of Germany

[73] Assignee: Westfalia Separator AG, Oelde, Fed. Rep. of Germany

[21] Appl. No.: 873,305

[22] Filed: Jan. 30, 1978

[30] Foreign Application Priority Data

Feb. 5, 1977 [DE] Fed. Rep. of Germany ..... 2704903

[51] Int. Cl.[2] ..... B04B 1/14

[52] U.S. Cl. ..... 233/20 A

[58] Field of Search ..... 233/20 R, 20 A, 19 R

[56] References Cited

U.S. PATENT DOCUMENTS 3,765,599 10/1973 Hemfort ..... 233/20 A

FOREIGN PATENT DOCUMENTS 125439 7/1949 Sweden ..... 233/20 A

*Primary Examiner*—George H. Krizmanich

*Attorney, Agent, or Firm*—Sprung, Felfe, Horn, Lynch & Kramer

[57] ABSTRACT

Centrifugal separator provided with openings (4) for ejection of solids, a piston valve (3) for opening and closing of the ejection openings, and an outer closing chamber (7) outfitted with a valve (13) and an inner closing chamber (6) outfitted with a valve (12) for the partial or complete discharge of control fluid from the control chambers for partial or complete discharge of solids. Means including a passageway (19), a central bore in the inner valve (12), and a choke (22) are provided so that the inner valve opens promptly following opening of the outer valve for controlled discharge of control fluid from the inner closing chamber upon discharge of control fluid from the outer closing chamber.

4 Claims, 2 Drawing Figures

SELF-DUMPING CENTRIFUGAL SEPARATOR

BACKGROUND

The invention relates to a self-dumping centrifugal separator having a piston valve defining one end of the separating chamber and solids chamber for the control of the ejection openings in the drum periphery, which permits the performance of partial and complete dumping selectively and independently of time, divides the closing chamber into a plurality of successive divisions, and is fed with control fluid in a known manner, hydraulically operated valves being installed in the passages for the discharge of the control fluid.

A centrifugal separator of this kind of construction is known, for example, from German Pat. No. 20 48 429, and is provided with a closing chamber consisting of two divisions, which is placed between the piston valve and the adjacent drum portion and is filled with a control fluid before the beginning of the centrifuging operation. The closing chamber has a greater radius than the interior of the drum, so that, when the chamber is completely filled, the closing pressure acting from this closing chamber side on the piston valve is always greater than the pressure of the drum charge acting from the other side in the opening sense. For the purpose of the ejection of solids, with the drum operating at full speed, control liquid is let out of the divisions of the closing chamber through hydraulically controlled valves, and thus the closing pressure is reduced. Under the pressure of the drum charge, the piston valve then moves to the open position releasing the ejection openings.

Depending on the nature and consistency of the solids being separated, it can be advantageous to perform partial dumping at shorter time intervals, or complete dumping at longer time intervals.

In the performance of partial dumping, the drum is opened only slightly and for a brief period of time, by letting control fluid out of either the inner or the outer division of the closing chamber through valves, so that only a portion of the solids that have collected in the solids chamber is ejected, while the other portion remains in the drum as a safety ring. This prevents the ejection and loss of any large amount of product liquid together with the solids.

Since in a partial dumping, only one division of the closing chamber is emptied of control fluid, the opening duration and the opening width of the self-dumping drum is limited, since control fluid always remains in the other division of the closing chamber. After the ejection of the solids has begun, as soon as the liquid level in the separating chamber has receded to the extent that the opening pressure is lower than the closing pressure of the control fluid remaining in the closing chamber, the piston immediately moves back to the closed position. The greater the closing pressure of the control fluid retained in the closing chamber is, the more rapidly the drum recloses, and the lesser will be the amount of solids that is ejected in each opening action.

In the performance of total dumping, the drum is opened wide and the entire content of the drum is ejected by letting control fluid out of both divisions of the closing chamber by means of the valves installed in the discharge passages.

It has been found disadvantageous in this centrifugal separator design that the piston valve does not open the gap at the periphery of the drum rapidly enough and far enough during complete dumping, since the two separately operated valves for the release of the control fluid can not be opened uniformly. A rapid and wide opening of the discharge gap in total dumping is necessary, however, in order that first the solids in the solids chamber will be ejected, and only then will the remaining product fluid be ejected.

In the event of a lagging drum opening, the danger exists that the product fluid will first be ejected through the solids ring in the solids chamber which breaks up during the emptying action, and then residues of solids will remain in the drum and might result in a dangerous imbalance of the drum. To eliminate this danger, the opening action has to be performed in a fraction of a second, and this is not possible with the two separately operated valves, since the valves are situated at different distances from the center and also open differently under the action of centrifugal force.

Furthermore, it has been found disadvantageous that, in the case of small opening widths and slow closing of the piston valve, the faces and gaskets on the piston valve and drum cover which seal the discharge gap are subject to severe wear due to the longer time which the solid matter or product liquid takes to flow through it.

In the case of partial dumping, there is the disadvantage in the known design that in each case only uniform opening times of the piston valve can be achieved according to which of the closing chambers is still filled in each case, and thus there is no way of controlling the concentration that is produced in the ejected solids.

THE INVENTION

The object of the invention therefore is to design centrifugal separators of the above-mentioned kind so that, when complete dumping is performed, the opening action in the drum can be performed more rapidly, and so that it will be possible to produce faster or slower partial dumping.

The object of the invention is accomplished by positively connecting the outlet passage of the outer closing chamber to an outlet passage of the inner closing chamber by an additional passage running from the outer closing chamber and by having the shut-off valve of the inner closing chamber release the inner outlet passage as soon as control fluid is released from the drum by the outer outlet valve.

The intercommunication of the outlet valves brings it about that, when the outer outlet valve is opened in the case of complete dumping, the inner valve also opens at the same time, and thus the outer closing chamber as well as the inner closing chamber is emptied of control fluid simultaneously and thus an abrupt opening of the drum takes place.

Through the special embodiment of the inner outlet valve, the control fluid remaining in the case of a partial dumping can be controlled such that longer or shorter partial dumping is possible and thus the concentration of the discharged solid matter can be controlled. Further information is to be found in the description of the specific embodiment of the drawings, of which:

Figure 1:
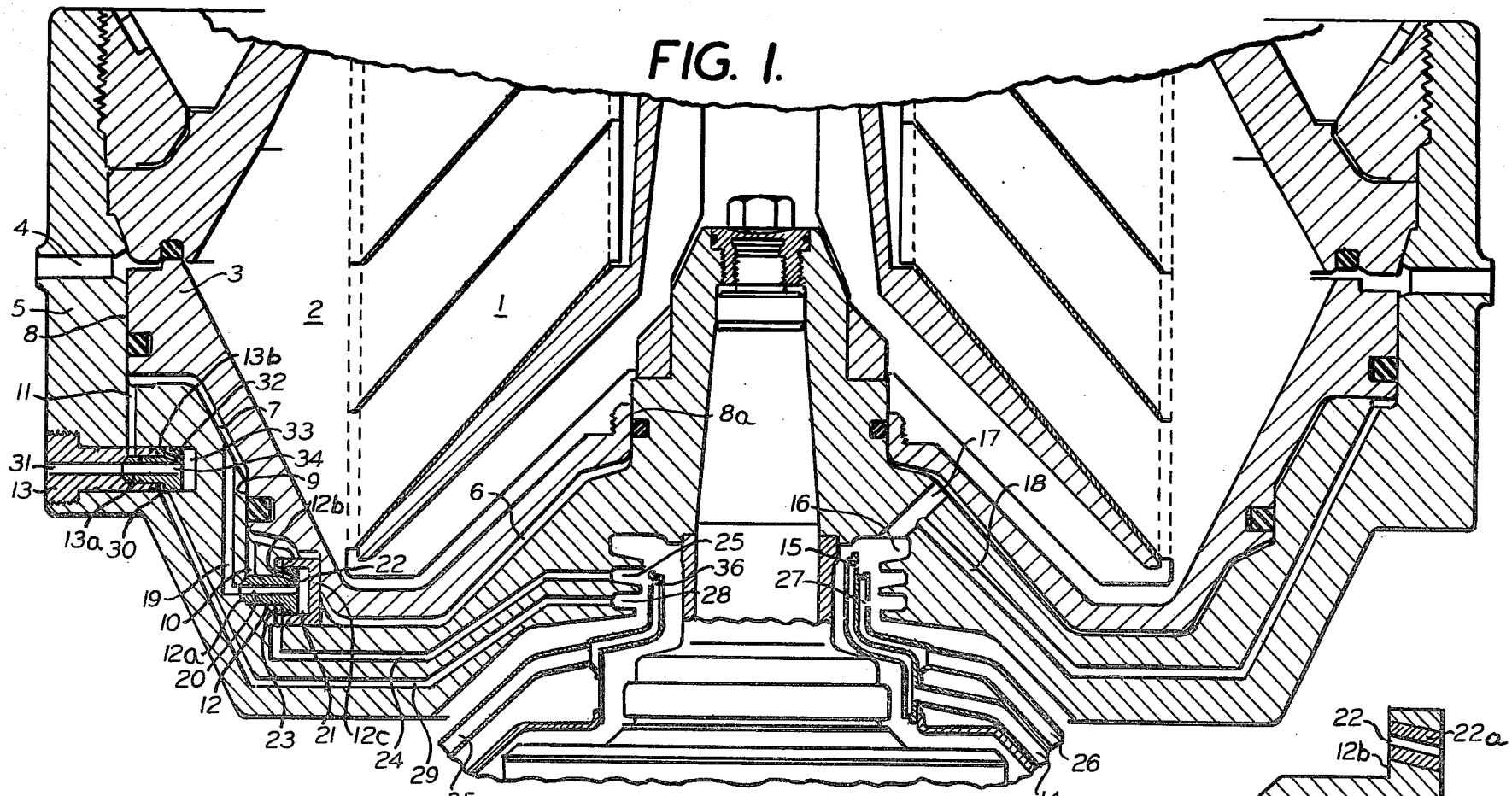
FIG. 1 is an elevation view in cross section.

Drawing 1 shows an embodiment of the invention, in which the left half of the drum is illustrated in the closed state and the right half in the open state.

In the drawing, the separating chamber 1 and the solids chamber 2 are defined at one end by the piston valve 3 which in its axial movements opens and closes the openings 4 for the ejection of the solids. Between the piston valve 3 and the adjacent drum part 5 there is the closing chamber which in this embodiment is divided into two parts which are situated radially one inside of the other and are sealed off from one another, namely the inner closing chamber 6 and the outer closing chamber 7. The piston valve 3 is sealingly guided at 9 on the adjacent drum part 5 in addition to the conventional guiding means at 8 and 8*a*.

From the radially outer end of the inner closing chamber 6 and the outer closing chamber 7 run outlet passages 10 and 11, which are opened and closed by valves 12 and 13. These valves shut off the outlet passages 10 and 11 during operation, under the action of centrifugal force on the valve cones 12*a* and 13*a* which are disposed and sealingly guided within the valves. Valve 12 includes cap 12*c* which is mounted in a fixed position in drum part 5.

Before the inlet for admitting the raw material to be separated is opened, the inner and outer closing chambers 6 and 7 are filled with a specific amount of control fluid by a controller which is not shown, the control fluid (closing fluid) being fed through line 14 and through ports 15 into the channel 16 and passages 17 and 18, bringing the piston valve 3 into the closed position (left side of the drawing). The control fluid flowing into the outer closing chamber 7 simultaneously fills the passage 19 which is in communication with this closing chamber, and the central bore 20 of the valve cone 12*a*, and chamber 21, and passes through chokes 22 in the cylindrical flange 12*b* of the valve cone into the annular passage 23, and into passage 24 to the channel 25. After a specific amount of solids have collected in the solids chamber 2, a partial or complete dumping of the separating drum takes place, depending on the nature and consistency of the solids.

In the partial dumping, control fluid is fed as opening fluid through the line 26 through ports 27 into the channel 28 and passage 29, and enters the annular passage 30 of valve 13 and moves the valve cone 13*a*, which is sealingly guided, radially towards the drum axis under the effect of the fluid pressure on the cylindrical flange 13*b* of the valve cone 13*a*, which overcomes the centrifugal force, so that the outlet passage 11 is opened. After the opening of the valve cone 13*a*, the control fluid that is under centrifugal force is discharged quite abruptly from the outer closing chamber 7 through passages 11 and 31. Since furthermore the pressure of fluid from passage 24 is acting on the cylindrical flange 12*b* of the valve cone 12*a*, a brief opening of the valve cone 12*a* also takes place, so that a portion of the control fluid also escapes from the inner closing chamber 6 through passages 10 and 19, the opening time and hence the amount of control fluid let out being regulated by an adjustable choke 22 which is in communication with passage 24 and bore 20 and passage 19. At the same time the piston valve 3 moves to the open position (right side of the drawing) and moves immediately back to the closed position when, as a result of the receding liquid level in the separating chamber 1 and solids chamber 2, the opening pressure has become lower than the closing pressure of the control fluid (closing fluid) left in the inner closing chamber 6 and simultaneously being fed in afresh through line 14 into the inner closing chamber 6. If there is a controlled feeding of control fluid into the inner closing chamber, it is thus possible to control the closing action of the piston valve 3. The control fluid (opening fluid) from passage 29 is carried out through a choke 32, chamber 33, bore 34 in valve cone 13*a*, and passage 31.

In the case of a complete dumping of the separating drum, in addition to the feeding of control fluid (opening fluid) through line 26, as described in the case of the partial dumping, a feeding of control fluid also takes place simultaneously through line 35, through ports 36 to the channel 25 and passage 24. The feeding of control fluid through the passage 24 simultaneously with the feeding of control fluid through the passage 29 brings it about that the discharging of the outer closing chamber 7, passage 19, bore 20 and chamber 21 takes place very rapidly, while at the same time, since the fluid pressure present in passage 24 due to the continuing feeding of control fluid through the annular passage 23 is acting on the cylindrical flange 12*b* of valve cone 12*a*, this valve cone is moved radially towards the axis and opens the discharge passage 10 of the inner closing chamber 6 and therefore, simultaneously with the discharging of outer closing chamber 7, an immediate discharge of the inner closing chamber 6 takes place through passage 10, passage 19, closing chamber 7, and passages 11 and 31. The closing action takes place each time in the manner described in the beginning. The controlling actions are initiated by means of a controller which is not illustrated.

Figure 2:
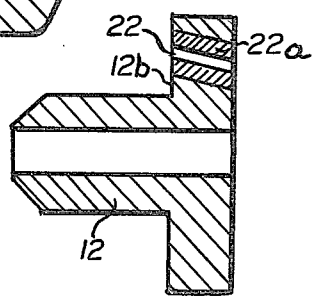
FIG. 2 is a cross section of a valve part of one of the valves.

Referring to FIG. 2, the choke 22 is made adjustable by employing replaceable insert 22*a* so that the desired bore size for the choke can be provided.

SUMMARY

Thus the invention provides an improvement in self-dumping centrifugal separators for the separation of solids from a liquid raw material. The known elements comprise a drum enclosing a separating chamber and a solids chamber for the separation and having solids ejection openings disposed about the drum periphery for ejection of separated solids, and a piston valve disposed in one of the axially spaced ends of the drum defining one end of the separating and solids chambers for opening and closing the solids ejection openings. Means define an outer closing chamber and an inner closing chamber, both disposed on the axially outward side of the piston valve for receiving and discharging of control fluid for operation of the piston valve, and means are provided for feeding control fluid to the control chambers. Also included are an outlet passageway (11) (herein reference numbers are used merely for the purpose of illustration) provided with an outer valve (13) for discharge of control fluid of the outer closing chamber and an outlet passageway (10) provided with an inner valve (12) for discharge of control fluid of the inner closing chamber for permitting selectively partial or complete ejection of separated solids. The improvement comprises means (19) for communicating the outlet passageway of the outer closing chamber with the outlet passageway of the inner closing chamber via the inner valve, and means (22,24) for opening of the inner valve in response to opening of the outer valve for discharge of control fluid from the inner closing chamber via the outlet passageway of the outer closing chamber upon opening of the outer valve.

In more detail, the separator may comprise a passageway (24) for delivery of control fluid to the inner valve for operation of the inner valve, the inner valve comprising a slidable valve cone (12*a*) having a flange (12*b*) and a cap (12*c*) mounted in a fixed position in the drum and forming with the valve cone a piston-cylinder combination, and providing a chamber (21) between the flange and the valve cap, the passageway (24) for delivery of control fluid to the inner valve being for delivery of control fluid to the valve flange for urging the inner valve cone to open the inner valve for communication of the outlet passageway (11) of the outer closing chamber with the outlet passageway (10) of the inner closing chamber. The means for opening the inner valve in response to opening of the outer valve may comprise a bore (20) in the cone of the inner valve communicating the means (passage 19) communicating the outlet passageway (11) of the outer closing chamber with the outlet passage (10) of the inner closing chamber, and the chamber (21) of the inner valve, and a choke (22) in the inner valve flange communicating the chamber of the inner valve with the passageway (24) for delivery of control fluid to the inner valve.

What is claimed is:

1. In a self-dumping centrifugal separator for the separation of solids from a liquid raw material comprising a drum enclosing a separating chamber and a solids chamber for the separation and having solids ejection openings disposed about the drum periphery for ejection of separated solids, a piston valve disposed in one of the axially spaced ends of the drum defining one end of the separating and solids chambers for opening and closing the solids ejection openings, means defining an outer closing chamber and an inner closing chamber both disposed on the axially outward side of the piston valve fro receiving and discharging of control fluid for operation of the piston valve, and means for feeding control fluid to the control chambers, an outlet passageway provided with an outer valve for discharge of control fluid of the outer closing chamber and an outlet passageway provided with an inner valve for discharge of control fluid of the inner closing chamber for permitting selectively partial or complete ejection of separated solids, the improvement which comprises means for communicating the outlet passageway of the outer closing chamber with the outlet passageway of the inner closing chamber via the inner valve, and means for opening of the inner valve in response to opening of the outer valve for discharge of control fluid from the inner closing chamber via the outlet passageway of the outer closing chamber upon opening of the outer valve.

2. Separator of claim 1, said means for opening of the inner valve in response to opening of the outer valve comprising a passageway for delivery of control fluid to the inner valve for operation of the inner valve, the inner valve comprising a valve cone having a flange having a choke communicating said means for communicating the outlet passageway of the outer closing chamber with the outlet passageway of the inner closing chamber and said passageway for delivery of control fluid to the inner valve.

3. Separator of claim 2, wherein the choke is a replaceable insert having a bore and is inserted in said flange.

4. Separator of claim 1, said means for opening of the inner valve in response to opening of the outer valve comprising a passageway for delivery of control fluid to the inner valve for operation of the inner valve, the inner valve comprising a slidable valve cone having a flange and a cap mounted in a fixed position in the drum and forming with the valve cone a piston-cylinder combination and providing a chamber between the flange and the valve cap, the passageway for delivery of control fluid to the inner valve being for delivery of control fluid to the valve flange for urging the inner valve cone to open the inner valve for communication of the outlet passageway of the outer closing chamber with the outlet passageway of the inner closing chamber, the means for opening the inner valve in response to opening of the outer valve comprising a bore in the cone of the inner valve communicating the means communicating the outlet passageway of the outer closing chamber with the outlet passage of the inner closing chamber and the chamber of the inner valve, and a choke in the inner valve flange communicating the chamber of the inner valve with the passageway for delivery of control fluid to the inner valve.

* * * * *